US005513847A

United States Patent [19]

Hu et al.

[11] Patent Number: 5,513,847

[45] Date of Patent: May 7, 1996

[54] MAGNETICALLY RESTORED GOLF PRACTICE DEVICE WITH VISUAL AND AUDIO DISPLAY

[76] Inventors: Chih-Chang Hu; Cha-Che Hu, both of c/o Hung Hsing Patent Service Center P.O. Box 55-1670, Taipei, Taiwan

[21] Appl. No.: 500,239

[22] Filed: Jul. 10, 1995

[51] Int. Cl.[6] ..... A63B 69/36

[52] U.S. Cl. ..... 473/140; 473/146; 473/149

[58] Field of Search ..... 273/185 D, 184 B, 273/200 R, 200 B, 197 R, 197 A

[56] References Cited

U.S. PATENT DOCUMENTS 2,834,210 5/1958 Crelinsten ..... 273/197 R X 5,390,930 2/1995 Hu ..... 273/197 R

*Primary Examiner*—George J. Marlo

[57] ABSTRACT

A golf practice device includes: a supporting base, a golf ball secured on a linking arm having a sleeve pivotally mounted on a shaft erected on the base, two rotor magnets having opposite outer magnetic poles and diametrically secured on two opposite ends of the sleeve, two stator magnets having opposite inner magnetic poles and secured on two opposite ends of a housing for surrounding the two rotor magnets for a mutual attraction between each stator magnet and each rotor magnet, a power generator having an iron core wound with coil windings on the core and surrounding the two rotor magnets for generating power due to change of magnetic field when rotating the sleeve and the two rotor magnets with respect to the iron core as driven by a hitting on the golf ball, and a display device for converting the power to an optical and audio signal for a visual and audio display for indicating the striking strength as hit by the golf player, and upon magnetic attraction between each stator magnet and each rotor magnet, the golf ball after the rotation will be stopped at its starting position as automatically restored by the magnetic attraction.

8 Claims, 8 Drawing Sheets

MAGNETICALLY RESTORED GOLF PRACTICE DEVICE WITH VISUAL AND AUDIO DISPLAY

BACKGROUND OF THE INVENTION

U.S. Pat. No. 5,390,930 to the same inventors of this application discloses a golf practice device including: a base, a golf ball secured on a linking arm having a sleeve pivotally mounted on a shaft erected on the base, two rotor magnets having opposite outer magnetic poles and diametrically secured on two opposite ends of the sleeve, and two stator magnets having opposite inner magnetic poles and respectively secured on two opposite ends of the shaft, with the two stator magnets diametrically aligned with the two rotor magnets fixed on the sleeve rotatably mounted on the shaft, each rotor magnet having an outer magnetic pole facing an inner magnetic pole of each stator magnet with the outer magnetic pole of the rotor magnet having a polarity opposite to a polarity of the inner magnetic pole of the stator magnet for a mutual attraction between each rotor magnet and each stator magnet, whereby upon striking of the ball by a club for rotating the ball, the ball will be stopped at its starting position as automatically restored by the magnetic force acting between each stator magnet and each rotor magnet.

Even though the golf ball will be automatically restored as disclosed in the U.S. Pat. No. 5,390,930, there is not provided with any optical and sound display upon striking on the ball, thereby still lacking of exciting interest for the player.

SUMMARY OF THE INVENTION

The object of the present invention is to provide a golf practice device including: a supporting base, a golf ball secured on a linking arm having a sleeve pivotally mounted on a shaft erected on the base, two rotor magnets having opposite outer magnetic poles and diametrically secured on two opposite ends of the sleeve, two stator magnets having opposite inner magnetic poles and secured on two opposite ends of a housing for surrounding the two rotor magnets for a mutual attraction between each stator magnet and each rotor magnet, a power generator having an iron core wound with coil windings on the core and surrounding the two rotor magnets for generating power due to change of magnetic field when rotating the sleeve and the two rotor magnets with respect to the iron core as driven by a hitting on the golf ball, and a display device for converting the power to an optical and audio signal for a visual and audio display for indicating the striking strength as hit by the golf player, and upon magnetic attraction between each stator magnet and each rotor magnet, the golf ball after the rotation will be stopped at its starting position as automatically restored by the magnetic attraction.

DETAILED DESCRIPTION

Figure 1:
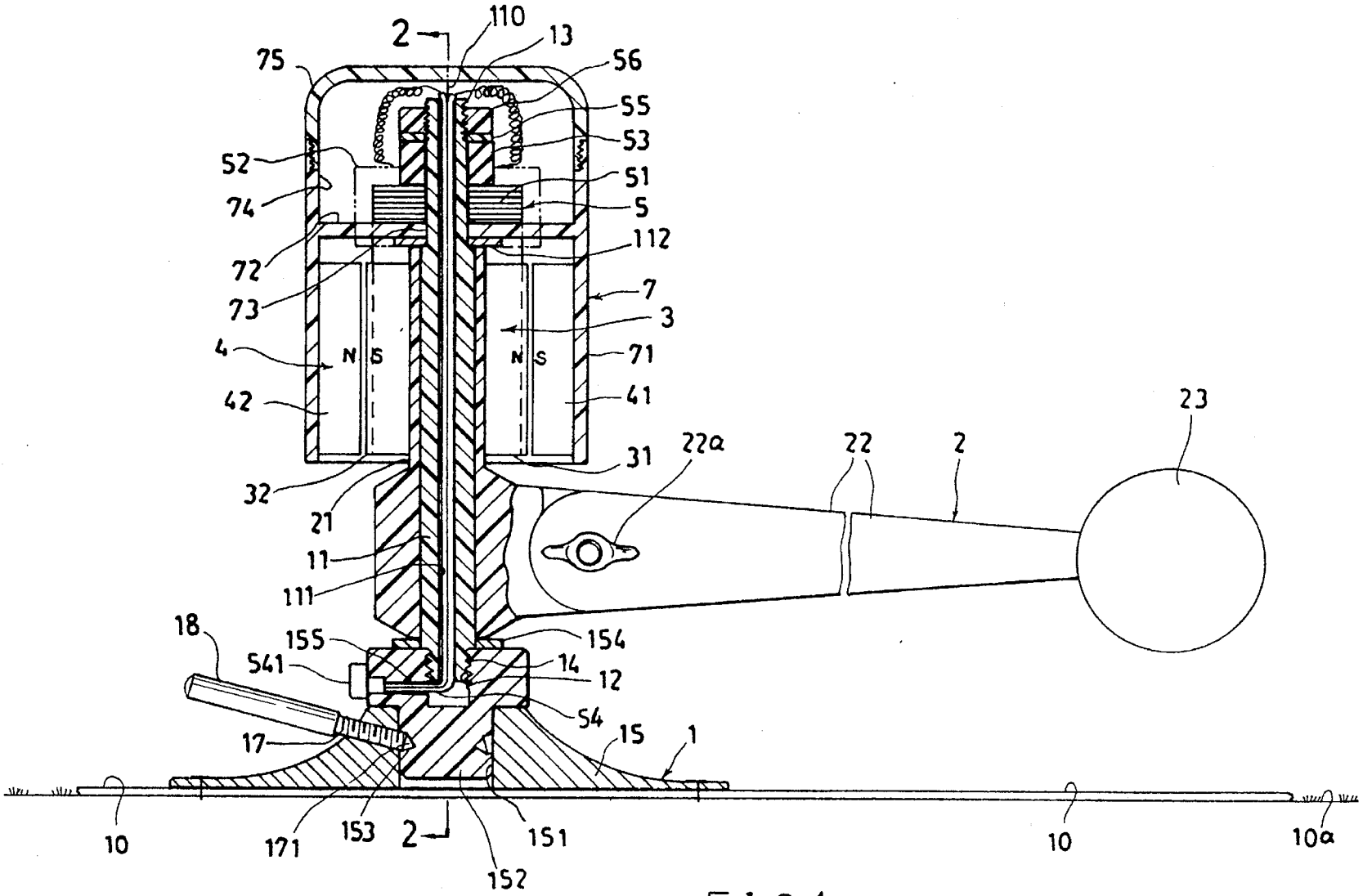
FIG. 1 is a sectional drawing of the present invention when erected.
Figure 2:
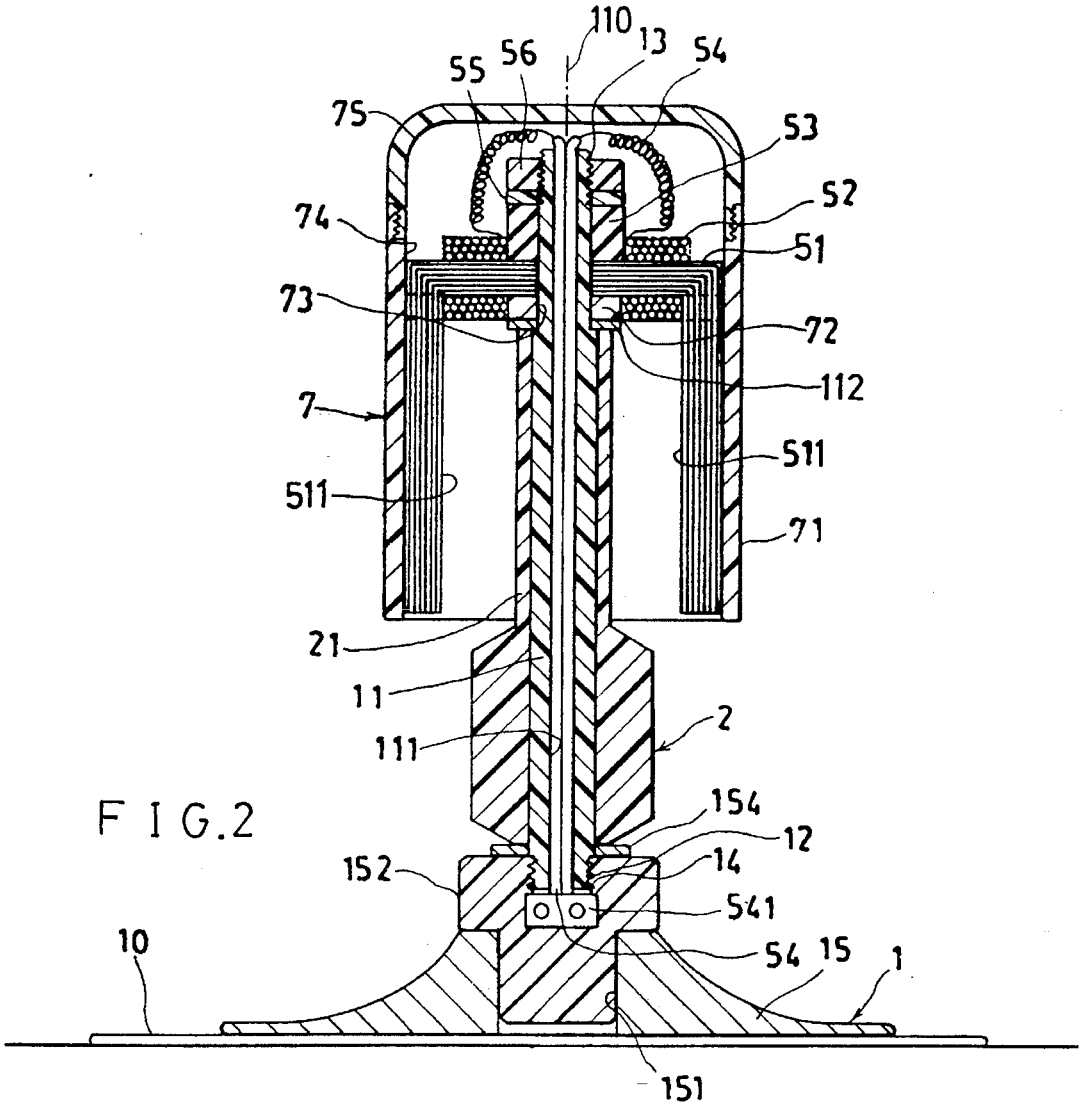
FIG. 2 is a sectional drawing of the present invention when viewed from 2—2 direction of FIG. 1.

As shown in FIGS. 1–10, the present invention comprises: a supporting base 1 laid on a supporting surface such as a mat 10 or grass yard 10*a* (FIG. 11), a ball means 2, a rotor magnet means 3, a stator magnet means 4, a power generating means 5, a display means 6, and a housing 7.

The supporting base 1 includes: a shaft 11 having a lower male-threaded portion 12 engageable with a female-threaded hole 14 formed in a coupling member 152 which is embedded in a socket 151 recessed in a base block 15, a washer 154 packed between the shaft 11 and the coupling member 152, an upper male-threaded portion 13 formed on an upper portion of the shaft 11 for securing the housing 7 and the power generating means 5 thereon, and a central opening 111 longitudinally formed through the shaft 11 for passing electric wires 54 of the power generating means 5 in the opening 111.

The coupling member 152 embedded in the base block 15 includes: an annular groove 153 annularly recessed in the coupling member 152, a locking bolt 17 having a bolt end 171 insertable in the base block 15 and engageable with the annular groove 153 in the coupling member 152 for locking the coupling member 152 when suitably positioned, and a handle 18 jacketed on the bolt 17 for driving the bolt 17.

Figure 11:
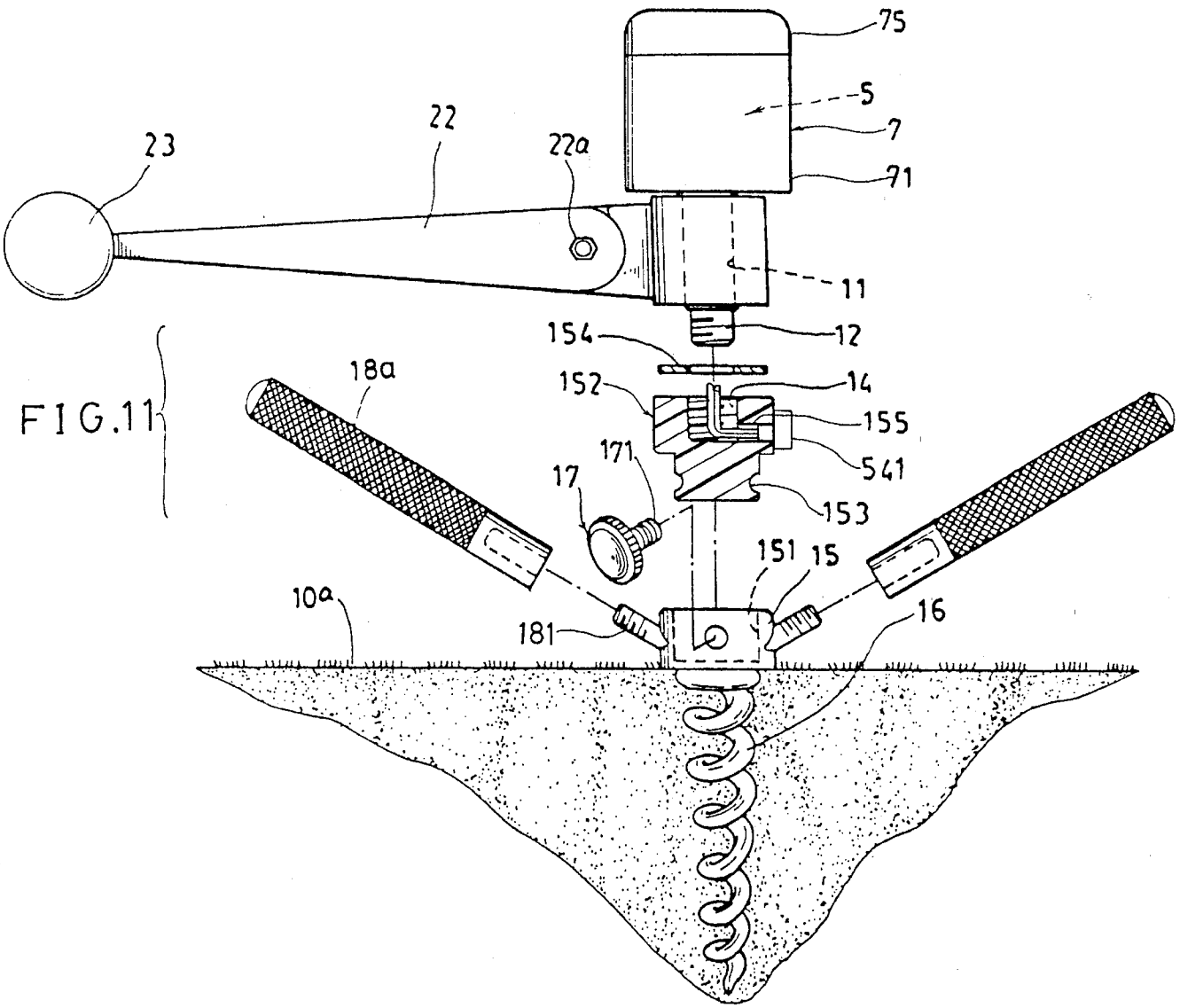
FIG. 11 shows another preferred embodiment of the supporting base of the present invention.

The base block 15 may be modified to be the embodiment as shown in FIG. 11, which includes: a fixing bolt 16 which may be a screw or a spiral coil protruding downwardly to be stably dug into a grass yard 10*a*, two shoulder connectors 181 protruding rightwardly and leftwardly from the block 15 for detachably mounting two handles 18*a* on the two connectors 181 for rotating the fixing bolt 16 for stabilizing the base 1 on the yard 10*a*, and a locking bolt 17 inserted through the base block 15 having a bolt end 171 engaged with the groove 153 recessed in the coupling member 152 for locking the coupling member 152 and the base 1 in position.

The base 1 may be secured on an area 101 of a mat 10 having a target line 100 marked on the mat for aiming a target of the golf ball 23, and a starting point 100*a* marked on the target line for a teeing position where the rotor magnet means 3 is magnetically attractable to the stator magnet means 4.

The ball means 2 includes: a sleeve 21 rotatably engageable with the shaft 11 of the base 1, a linking arm 22 having an inner arm end pivotally connected to a lower portion of the sleeve 21 by a bolt 22*a* and an outer arm end secured with the golf ball 23, with an upper portion of the sleeve 21 secured with the rotor magnet means 3. The linking arm 22 will be pivoted about the bolt 22*a* for adjusting the height of the ball 23 above the mat or yard.

The rotor magnet means 3 includes: a first rotor magnet 31 and a second rotor magnet 32 diametrically secured on two opposite end portions of the sleeve 21, with the first rotor magnet 31 having an outer magnetic pole (such as N pole) opposite in polarity to an outer magnetic pole (such as S pole) of the second rotor magnet 32.

The stator magnet means 4 is disposed around said rotor magnet means 3, and includes: a first stator magnet 41 and a second stator magnet 42 respectively fixed on two opposite end portions of the housing 7 preferably at the lower housing portion 71, with the first stator magnet 41 having an inner magnetic pole (such as S pole) facing to and opposite in polarity to an outer magnetic pole (such as N pole) of the first rotor magnet 31 and having an inner magnetic pole (such as S pole) of the first stator magnet 41 opposite in polarity to an inner magnetic pole (such as N pole) of the second stator magnet 42.

The housing 7 includes a lower housing portion 71 below a central partition plate 72, an upper housing portion 74 above the partition plate 72, and a cap 75 closing the upper housing portion 74.

Figure 3:
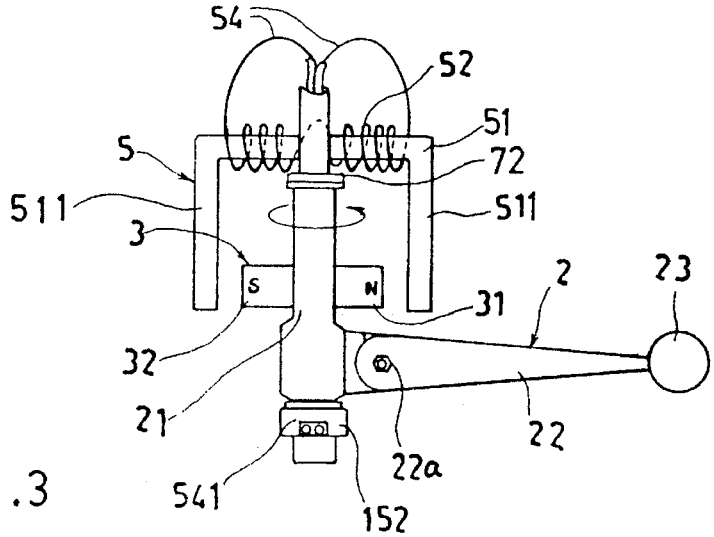
FIG. 3 is an illustration showing the power generating means of the present invention.
Figure 4:
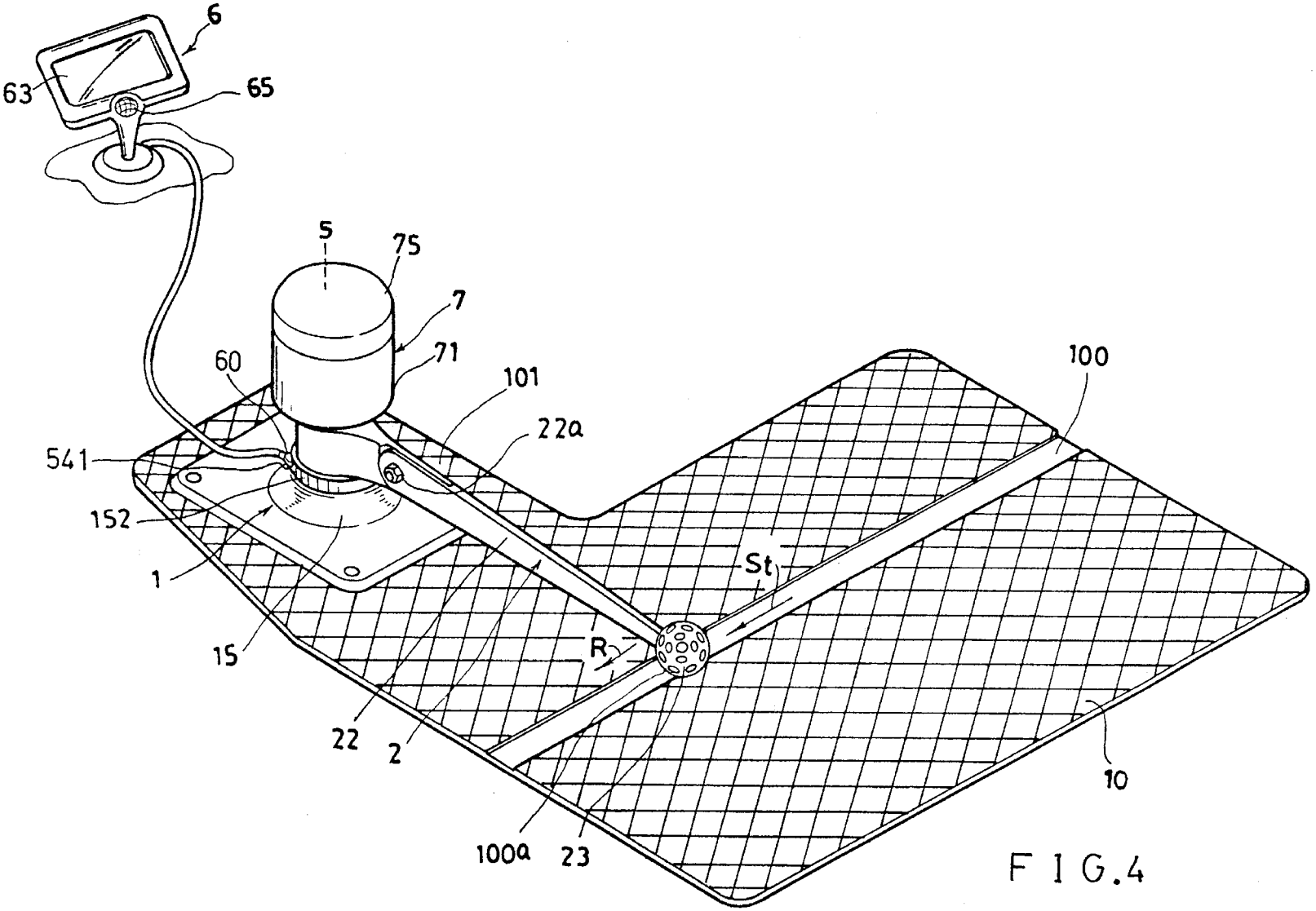
FIG. 4 is a perspective view of the present invention.

The power generating means 5 includes: a power generating iron core 51 having two core arm members 511 generally inversed U shaped and diametrically mounted on an upper portion of the shaft 11 of the base 1 as packed on the central partition plate 72 and a washer 112 to be angularly deviated from the two stator magnets 41, 42 for 90 degrees about a longitudinal axis 110 of the shaft 11 (FIGS. 1, 2 and 10), with the two core arm members 511 protruding downwardly through the central partition plate 72 of the housing 7 to surround the two rotor magnets 31, 32 when rotated as shown in FIG. 3, a power generating coil 52 wound on the core 51 and having a pair of electric wires 54 led from two opposite ends of the coil 52 and passing through the central opening 111 in the shaft 11 to connect an electric socket 541 formed in the coupling member 152 for connecting the display means 6 through a connector 60, with the core 51 retained on a top threaded portion 13 of the shaft 11 by means of an insulative washer 53, a thin washer 55 and a nut 56, whereby upon hitting on the golf ball 23 by a club (not shown), the linking arm 22 and the rotor magnets 31, 32 secured to the sleeve 21 on the inner end of the linking arm 22 will be rotated to induce electric current in the coil 52 wound on the core 51 for producing power through the electric wires 54 passing through wire holes 155 in the coupling member 152 for outputting current and voltage signals through the connector 60 of the display means 6 to a visual (optical) and an audio display as shown in FIGS. 5–9. A shaft hole 73 is formed in the partition plate 72 for rotatably engaging the shaft 11.

The display means 6 and the power generating means 5 as shown in the drawing figures are only examples in accordance with the present invention, which are not limited and may be modified.

Figure 10:
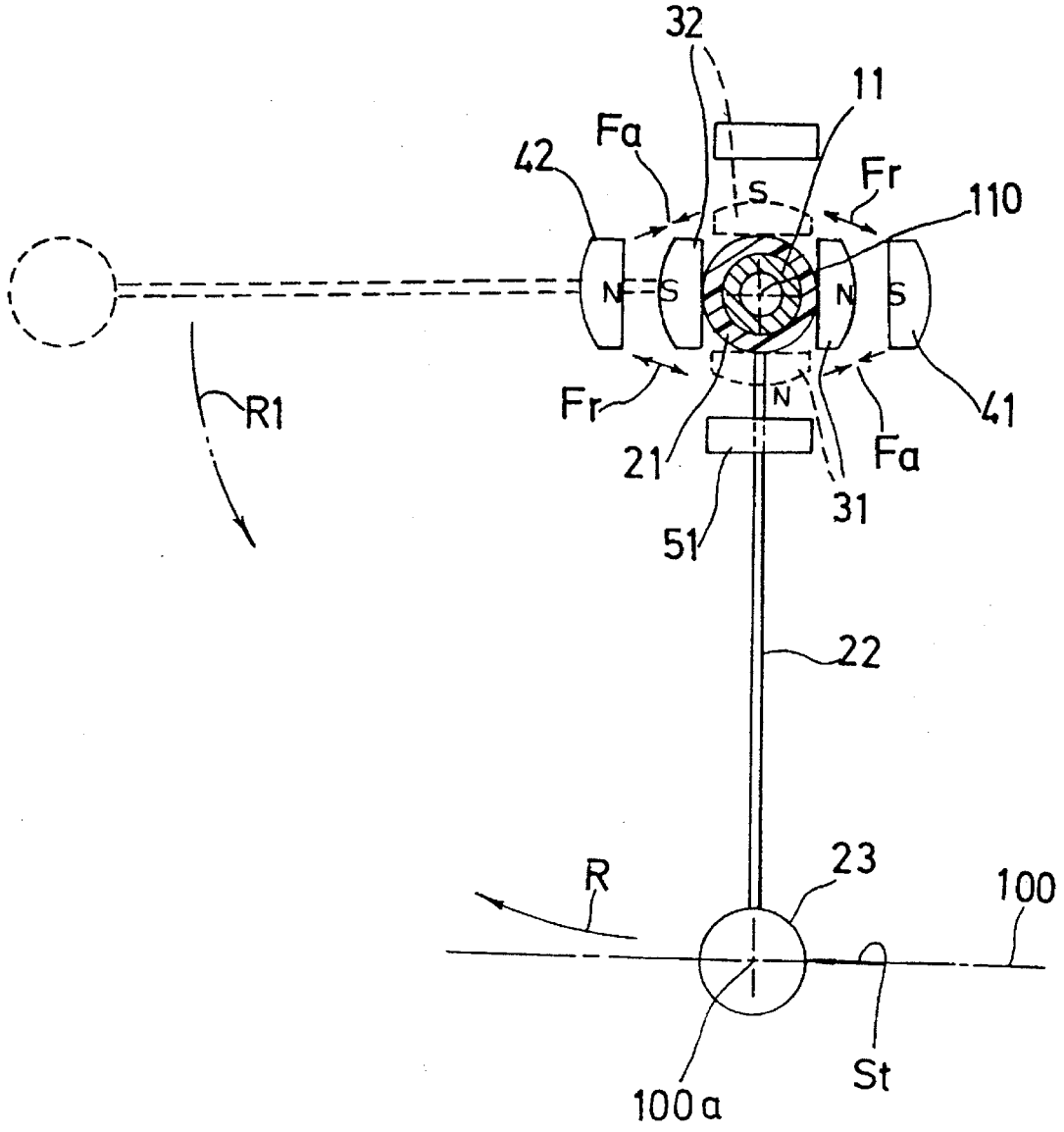
FIG. 10 is an illustration showing a magnetic restoring of the golf ball at its starting position in accordance with the present invention.

As shown in FIG. 10, when the golf ball 23 is stricken (direction St) by a club from the starting point 100*a*, the ball 23 and the arm 22 will be rotated (R) about the shaft 11. After rotating of several turns, the ball 23 and its link 22 may be finally stopped as deviated from the starting point 100*a* as shown in dotted line of FIG. 10, the magnetically attractive force Fa between the opposite poles of the stator magnet and the rotor magnet as well as the magnetically repulsive force Fr between the same poles of stator magnet and the rotor magnet will automatically restore (R1) the sleeve 21, the arm 22 and the ball 23 to its original starting point 100*a* ready for a next convenient striking on the ball.

Figure 5:
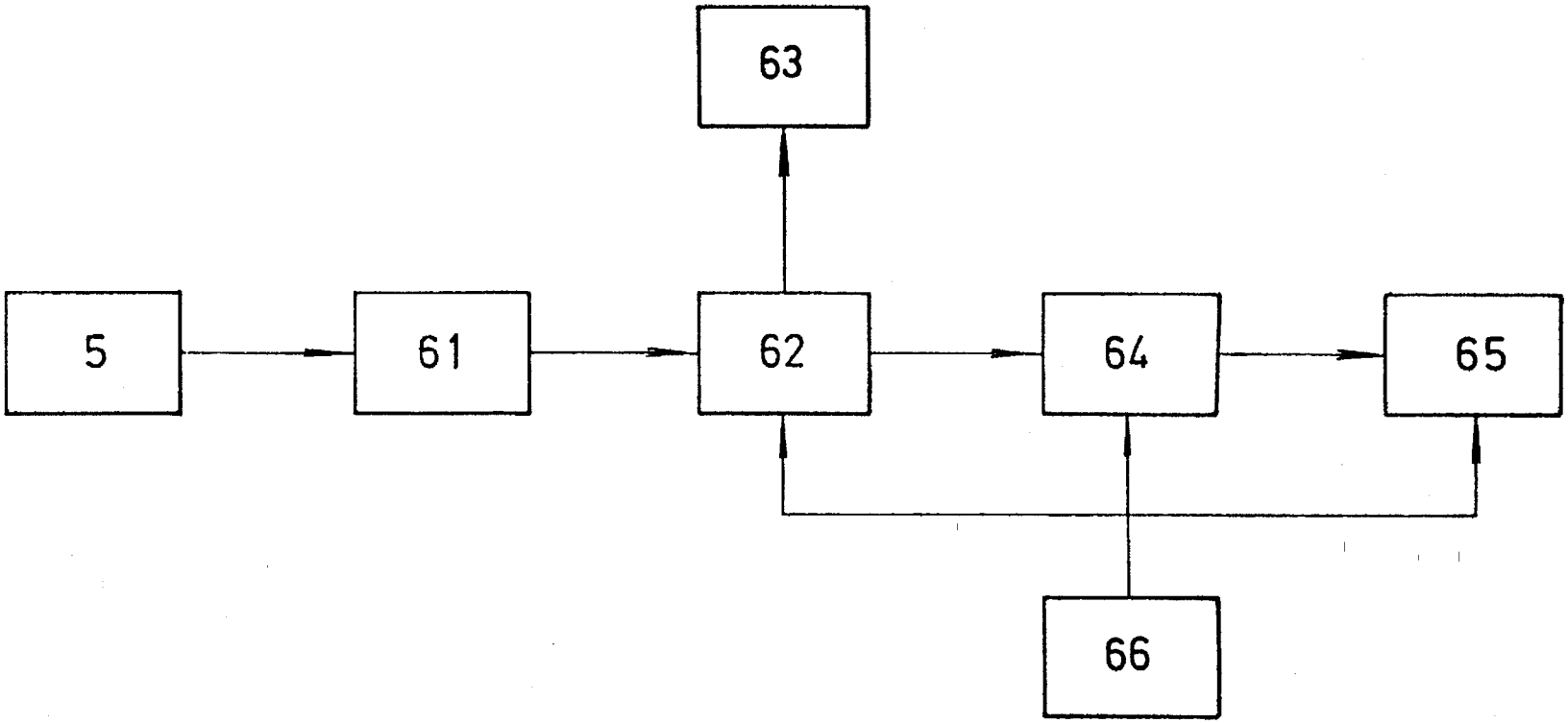
FIG. 5 is a block diagram of the display means of the present invention.

The display means 6 as shown in FIG. 5 includes: a receiver 61 for receiving input current and voltage signal produced from the power generating means 5 through a connector 60 and rectifying the input current, a control circuit 62 triggered by the current and voltage signal as received from the receiver 61 and processing the signals for outputting visual signal to a visual display 63 and an audio signal to an audio display 65 through a sound producing circuit 64.

Figure 7:
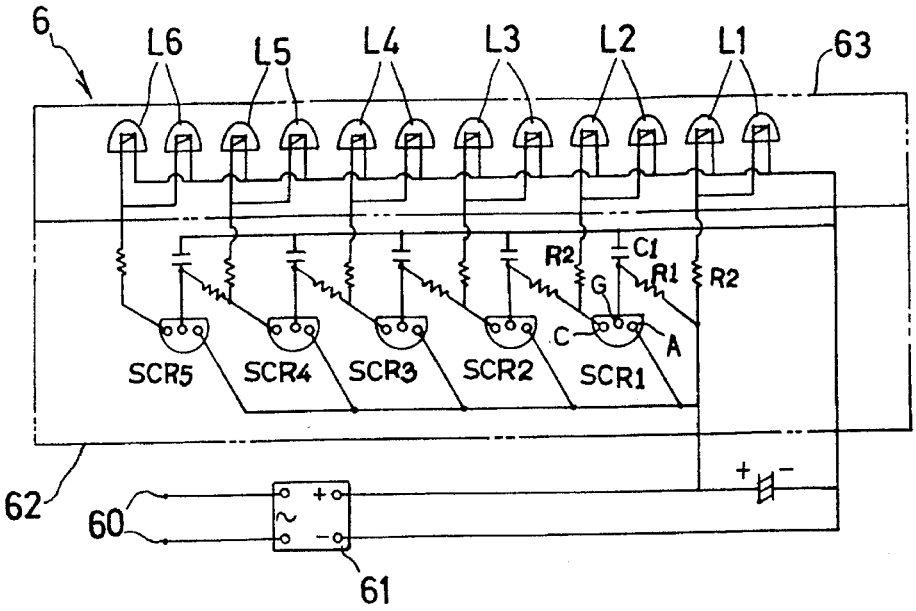
FIG. 7 shows an electronic circuit of a visual display in accordance with the present invention.
Figure 6:
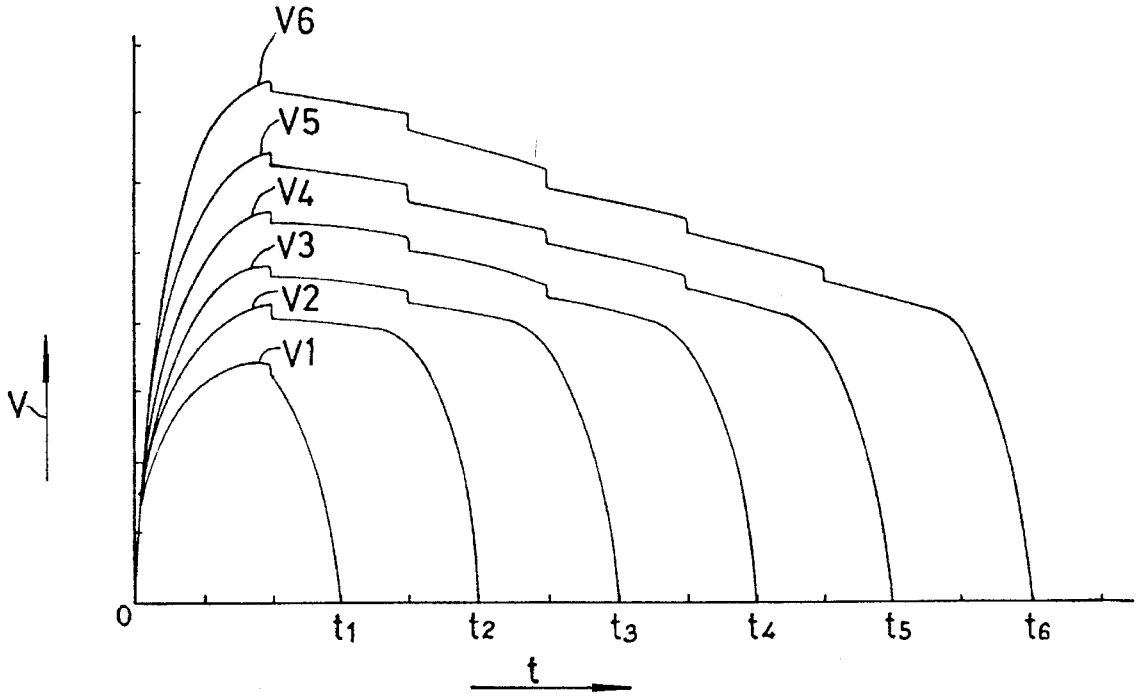
FIG. 6 shows a diagram of voltage curves versus power generating time period upon hitting on golf ball of the present invention.

The voltage of the input signal produced from the power generating means 5 is proportional to the striking strength acting on the golf ball 23 and the input signal will trigger the control circuit 62 which may be an integrated circuit or a circuit comprised of a plurality of silicon-controlled rectifiers (SCR) as shown in FIG. 7. A stronger striking on the ball 23 will produce a larger voltage value such as V6 and will have a longer duration for generating the power such as t6 as shown in FIG. 6. The control circuit 62, once being triggered by the input signal, will process the input signal to output a visual signal and an audio signal of different ratings such as subsequent illumination of a plurality of light-emitting diodes L1~L6 as shown in FIG. 7 each diode corresponding to each predetermined illuminating time interval different from the other. The stronger the ball is hit, the longer power generation will be obtained by the power generating means 5 and the corresponding LED may then be lit on at a delayed or longer time commensurating with the longer duration of power generation.

The display means 6 as shown in FIG. 7 includes: a connector 60 connected to the socket 541 of the power generating means 5 for transmitting input current and voltage signal from the power generating means 5, a receiver 61 for receiving and rectifying the input signal from the power generating means 5, a control circuit 62 including a plurality of silicon-controlled rectifiers SCR1~SCR5 connected in series between the receiver 61 and a visual display 63 which includes a plurality of light-emitting diodes L1~L6 connected in series, each silicon-controlled rectifier (SCR) having an anode A connected to a positive pole of the input current, a gate G connected to a time-delay circuit comprised of a capacitor C1 and a resistor R1 connected in series between the positive and negative poles of the input current having a pre-set time delay for triggering the gate G at a delayed time to conduct the SCR, and a cathode C connected to a light emitting diode (LED) through a resistor R2 for limiting a safe voltage value for illuminating the LED and connected to a gate G of a next SCR, thereby subsequently delaying the conduction of the plurality of silicon-controlled rectifiers for subsequently lighting the plurality of light emitting diodes with respect to the time duration of power generation in response to the striking strength acting on the golf ball.

Therefore, when a first striking on the ball to produce a first voltage value V1 (as shown in FIG. 6) having a power-generation time duration of t1, the first set of light emitting diodes (LED) L1 (FIG. 7) will be initially illuminated until the lapse of t1 and the SCR1 will be charged by its pre-set time delay constant of R1 and C1 and then conducted until the lapse of first time period t1, and a second striking (V2) will continue the power generation to allow SCR1 to power and light on the second set of LED L2 until the lapse of second time period t2. During the illumination of second set of LED L2, the SCR2 is being charged for its conduction and once being conducted until the lapse of t2, the SCR2 will power and turn on the third set of LED L3 if a third striking is acted on the ball to have a third voltage value V3 which is larger than V2. The L3 will be continuously turned on until the lapse of t3 or until the power produced by third striking is exhausted. By the way, the plural LEDs will be subsequently lit on showing the different ratings of striking strength from a weak degree to a strong degree when hitting the golf ball, thereby enhancing a player's interest. Different colors may be provided on the plural light-emitting diodes for a remarkable visual indication.

Figure 8:
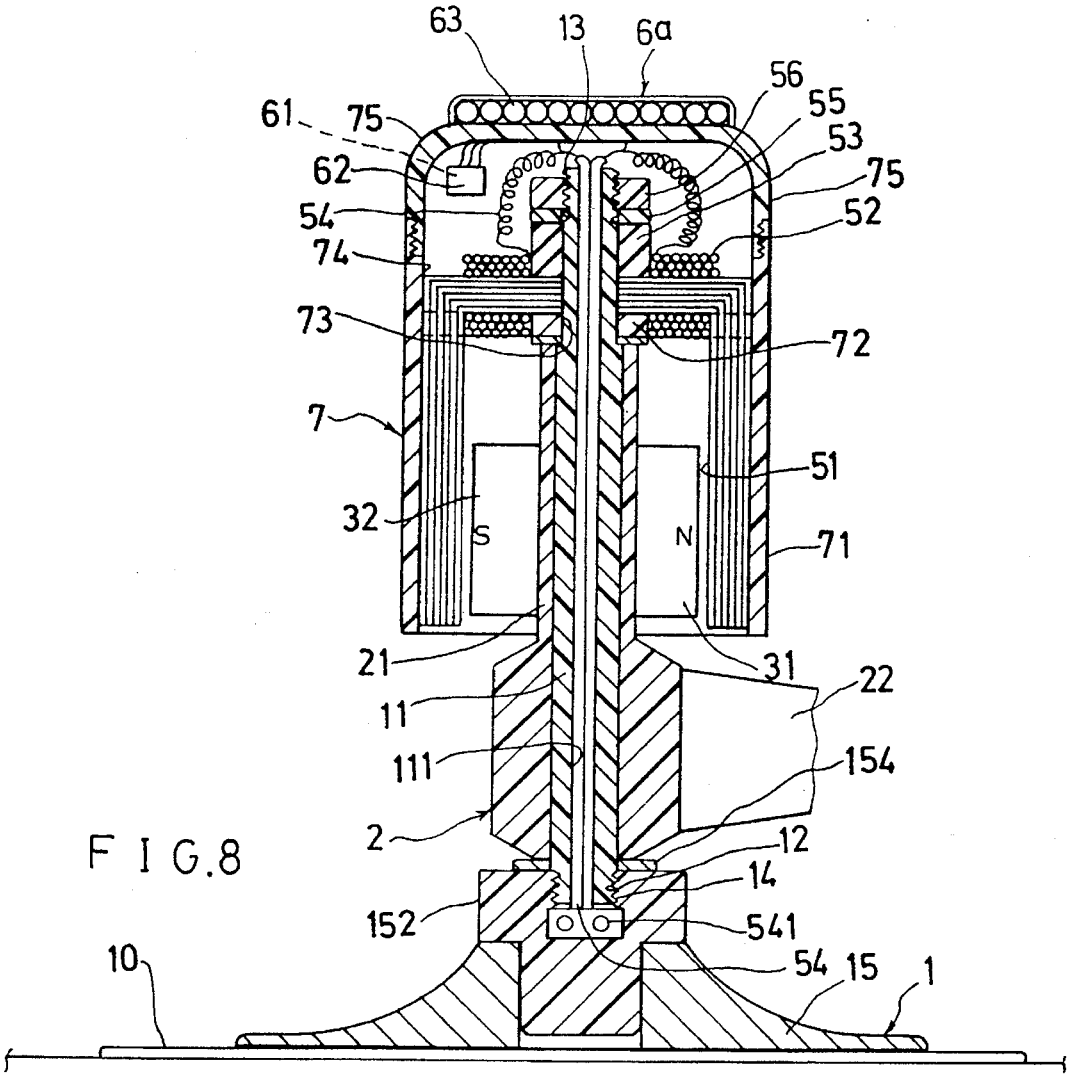
FIG. 8 is an illustration of the present invention provided with LED display.
Figure 9:
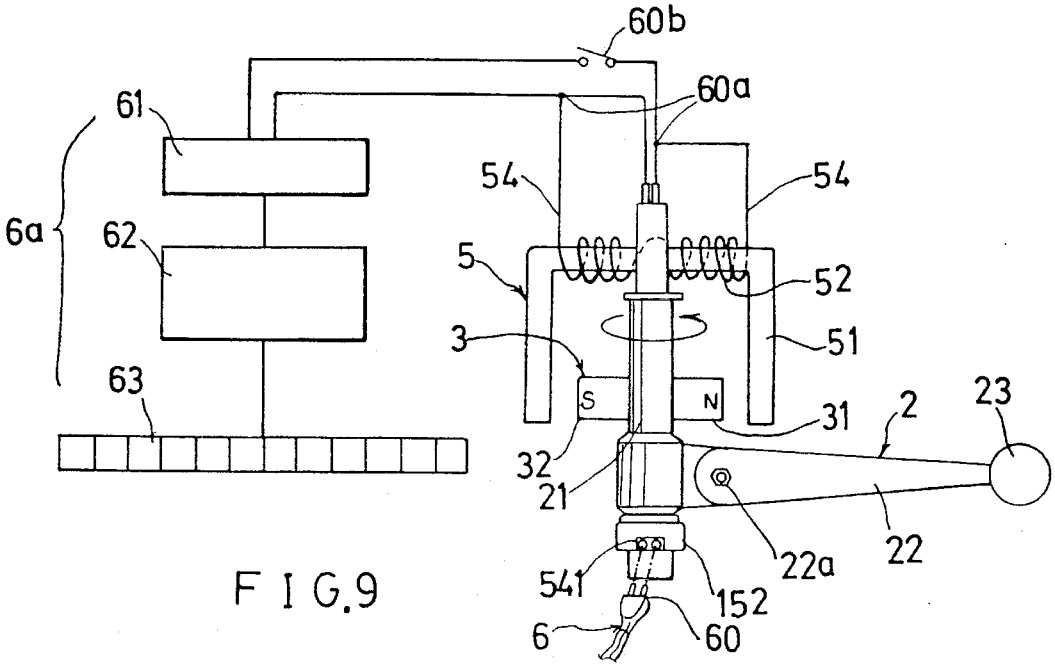
FIG. 9 shows an electronic circuit of the present invention with LED display.

The visual display 6*a* may be mounted on the housing 7 and connected to the wires 54 by connector 60*a* and switch 60*b* as shown in FIGS. 9, 8. A remote display system may be connected to the socket 541 by a connector 60 as shown in FIG. 9

The audio display 65 as shown in FIG. 5 includes: an amplifier and a speaker for amplifying the sound signal produced by the sound producing circuit 64 connected to the control circuit 62 for loudspeaking an output audio signal such as by sound, voice or music. For instance, a stronger hitting on ball may be converted to a stronger current and voltage signal for selecting an output sound, such as: a stronger whistling, a praising voice (for example: "very good"), or a playing of march music. The control circuit 62 may select the output sound signals with different ratings as pre-programmed in the control circuit 62 in response to the input current and voltage signal as produced and transmitted from the power generating means 5. An auxiliary power supply 66 may be provided for powering the circuits in control circuit 62, sound producing circuit 64, and the audio display 65.

Other audio or visual display methods, circuits or systems may be modified in accordance with the present invention, without departing from the spirit and scope of this invention.

We claim:

1. A golf practice device comprising:

a supporting base, a ball means having a golf ball secured on a linking arm having a sleeve pivotally mounted on a shaft erected on the base, a rotor magnet means having at least two outer magnetic poles having opposite polarities with each other and diametrically secured on two opposite end portions of the sleeve, a stator magnet means having at least two inner magnetic poles having opposite polarities with each other and diametrically secured on two opposite side portions of a housing for surrounding said rotor magnet means for a mutual attraction between said stator magnet means and said rotor magnet means, a power generating means having a power generating core wound with coil thereon and surrounding said rotor magnet means for generating power when rotating the golf ball, the sleeve and said rotor magnet means with respect to the core when hitting the golf ball, and a display means electrically connected to said power generating means for converting a power signal from said power generating means to a visual and audio signal for a visual and audio display for indicating a striking strength when hitting the golf ball by a player, and upon magnetic attraction between said stator magnet means and said rotor magnet means, the golf ball after being rotated will be stopped at a starting position as automatically restored by the magnetic attraction between said stator and rotor magnet means.

2. A golf practice device according to claim 1, wherein said ball means includes: said linking arm having an inner arm end pivotally connected to a lower portion of the sleeve by a bolt and an outer arm end secured with the golf ball, said linking arm being pivotal about the bolt for adjusting a height of the ball above a mat.

3. A golf practice device according to claim 1, wherein said rotor magnet means includes: a first rotor magnet and a second rotor magnet diametrically secured on two opposite end portions of the sleeve, with the first rotor magnet having an outer magnetic pole opposite in polarity to an outer magnetic pole of the second rotor magnet.

4. A golf practice device according to claim 1, wherein said stator magnet means includes: a first stator magnet and a second stator magnet respectively fixed on two opposite end portions of the housing, with the first stator magnet having an inner magnetic pole facing to and opposite in polarity to an outer magnetic pole of the first rotor magnet and having an inner magnetic pole of the first stator magnet opposite in polarity to an inner magnetic pole of the second stator magnet.

5. A golf practice device according to claim 1, wherein said power generating means includes: said power generating iron core having two core arm members generally inversed U shaped and diametrically mounted on an upper portion of the shaft of the base as packed on a central partition plate of said housing to be angularly deviated from said stator magnet means about a longitudinal axis of the shaft, with said two core arm members protruding downwardly through the central partition plate of the housing to surround said rotor magnet means when rotated, said coil wound on the core having a pair of electric wires led from two opposite ends of the coil and passing through a central opening formed in the shaft to connect an electric socket formed in the base for connecting the display means, with the core retained on a top portion of the shaft, whereby upon hitting on the golf ball, the linking arm and the rotor magnet means secured to the sleeve on an inner end of the linking arm will be rotated to induce electric current in the coil wound on the core for producing power through the electric wires for outputting current and voltage signals to said display means.

6. A golf practice device according to claim 5, wherein said display means includes: a connector connected to the socket of the power generating means for transmitting input current and voltage signal from the power generating means, a receiver for receiving and rectifying the input current and voltage signal from the power generating means, a control circuit including a plurality of silicon-controlled rectifiers connected in series between the receiver and a visual display which includes a plurality of light-emitting diodes connected in series, each said silicon-controlled rectifier having an anode connected to a positive pole of an input current, a gate connected to a time-delay circuit comprised of a capacitor and a resistor connected in series between a positive and a negative pole of an input current having a pre-set time delay for triggering the gate at a delayed time to conduct the silicon-controlled rectifier, and a cathode connected to one said light emitting diode through a voltage-limiting resistor for limiting a safe voltage value for illuminating the light-emitting doide and connected to a gate of a next silicon-controlled rectifier connectable to a next light-emitting diode, thereby subsequently delaying the conduction of the plurality of silicon-controlled rectifiers for subsequently lighting the plurality of light emitting diodes with respect to the time duration of power generation by said power generating means in response to the striking strength of different hits on the golf ball.

7. A golf practice device according to claim 5, wherein said display means includes: a receiver for receiving and rectifying an input current and voltage signal produced from said power generating means, a control circuit operatively receiving said input current and voltage signal from said receiver, and operatively selecting a plurality of output visual signals with different ratings to be distinguishably displayed on a visual display and operatively selecting a plurality of output audio signals with different ratings to be distinguishably displayed on an audio display in response to an current and voltage value of the input current and voltage signal corresponding to a striking strength on the golf ball.

8. A golf practice device according to claim 7, wherein said display means includes: a sound producing circuit connected to said control circuit for producing audible sound signal from an output audio signal output from said control circuit, and said audio display connected to said sound producing circuit for amplifying and loudspeaking the audible sound signal of said sound producing circuit.

* * * * *